US005824946A

United States Patent [19]

Cwalina

[11] Patent Number: 5,824,946

[45] Date of Patent: Oct. 20, 1998

[54] UNDERWATER SEARCH ANGLE SELECTION SYSTEM AND METHOD OF SPECIAL UTILITY WITH SURFACE CONTACTS

[75] Inventor: David S. Cwalina, Tiverton, R.I.

[73] Assignee: The United States of America as represented by the Secretary of the Navy, Washington, D.C.

[21] Appl. No.: 885,700

[22] Filed: Jun. 30, 1997

[51] Int. Cl.[6] ..... F42B 19/01

[52] U.S. Cl. ..... 114/21.3; 114/23

[58] Field of Search ..... 114/21.2, 21.3, 114/23; 244/3.11, 3.12

*Primary Examiner*—Charles Jordan
*Assistant Examiner*—Matthew J. Lattig
*Attorney, Agent, or Firm*—Michael J. McGowan; Michael F. Oglo; Prithvi C. Lall

[57] ABSTRACT

A search angle selection system generates a search angle for a torpedo in response to a number of inputs. Initially, the system bounds the region to be insonified. The system determines the search angle which best insonifies the region from the surface down to the target's keel depth out to the maximum acquisition range of the torpedo, for each search depth accounting for the torpedo's attack angle. The system determines a set of attainable aimpoints along the surface which are based on the environmental and weapon parameters. It then finds rays which intersect the aimpoints and uses the ray angles to determine an optimal beam steering angle. For each search depth, the system categorizes the sound speed profile between the search depth and the surface, and determines the maximum range that can physically be reached from the search depth. Using the maximum range and the weapon's range gate, a maximum aimpoint is established. Using information on the extent of the beam pattern used by the torpedo, the system generates a minimum aimpoint. A number of evenly-spaced aimpoints are generated between the maximum and minimum aimpoints. Critical rays to all of the aimpoints are found from which the optimal beam steering angles are determined. From the optimal beam steering angles, the weapon's search angles are selected.

6 Claims, 4 Drawing Sheets

UNDERWATER SEARCH ANGLE SELECTION SYSTEM AND METHOD OF SPECIAL UTILITY WITH SURFACE CONTACTS

STATEMENT OF GOVERNMENT INTEREST

The invention described herein may be manufactured by or for the Government of the United States of America for Governmental purposes without the payment of any royalties thereon or therefor.

CROSS REFERENCES TO RELATED PATENT APPLICATION

The instant application is related to one co-pending U.S. Patent Application entitled UNDERWATER ACOUSTIC SEARCH ANGLE SELECTION SYSTEM AND METHOD OF SPECIAL UTILITY WITH SUBMERGED CONTACTS (Ser. No. 08/885,702) having same filing date.

BACKGROUND OF THE INVENTION (1) Field of the Invention

The invention relates generally to the field of torpedo weapon order generation and more particularly to systems and methods for selecting target search angles for torpedoes.

(2) Description of the Prior Art

Torpedo performance is characterized by the ability of the torpedo to detect and home in on a target. Target detection is determined by the ability of the torpedo to acoustically differentiate between the target signal and background noise. The probability of target detection can be improved through proper selection of weapon preset settings. Accurate prediction of a weapon's acoustic performance is required so as to select among a large number of possible preset combinations to obtain the set that is optimal. The optimal set determines the search depth for the weapon, the search angle of the weapon, the acoustic mode, the weapon speed, and affects the weapon placement in the horizontal plane. The optimal set is a function of the target and of the particular environmental and tactical scenario. Upon determination of the acoustic presets, they may be provided to the torpedo prior to launch.

A significant problem in the selection of the torpedo acoustic presets is the procedure by which a search or pitch angle is associated with a given search depth. Torpedoes can be preset to search for a target at a fixed number of depths, which are referred to as search depths. They can also be preset to adjust their acoustic beams to a fixed number of off-axis angles called search or pitch angles. Since only one search or pitch angle can be associated with a particular search depth, it is necessary to determine the value which provides the maximum probability of target detection. This value is a function of the environment, the tactical and target scenario, and intrinsic weapon dynamics.

There are several ways in which search angles have been determined. In one way, search angles are provided in table look-ups. Each table is associated with a predefined speed profile and consists of a number of sub-tables, each of which is categorized by whether the search is to be in deep or shallow water, whether the target is a surface ship or submarine, whether there is a high or low target Doppler, high or low sea state, high or low target strength, and whether the target is active or passive. The sub-tables are populated by a list of available search depths, associated search angles, and a probability value identifying the probability that a search will be effective. The pitch angle is selected by exhaustively running all combinations of search depth and search angle on a weapon simulation model and selecting the search angle that provides the highest probability of effectiveness. This exhaustive search can take a relatively long time to complete. In addition, there are deficiencies in developing the tables in a number of areas, including environmental, tactical, target and weapon. For each area, a number of samples are considered, which may be only gross or poor matches for the values which may be encountered in an actual situation.

A second methodology, called the pilot ray algorithm, determines the search angle to associated with each of the torpedo's available search depths. The algorithm accepts tactical information as an input, including selection of the type of tactic as (1)unknown submarine, (2) submarine above the oceanographic layer, (3)submarine below the oceanographic layer, and (4) surface target. In accordance with the algorithm, the oceanographic layer depth is determined (the depth is the depth of maximum sound speed down to a predetermined maximum depth), and a maximum and minimum depth of interest is determined from the selected tactic, the oceanographic layer depth, the target's maximum operating depth, the torpedo's floor setting and the bottom depth. The algorithm iterates over the available search depth settings to determine the search angle. For each search depth a pilot ray is generated by a process which starts with the sound speed at the search depth, and which includes further processing based upon a comparison with sound speed at the layer depth. If the sound speed at the search depth is less that the sound speed at the layer depth, then Snell's Law of Refraction is used to compute a preliminary pilot ray angle which is the off-axis ray angle which vertexes at the layer depth, but if the sound speed at the search depth is greater than the sound speed at the layer depth, the preliminary pilot ray angle is set to zero. Thereafter a differential depth correction, consisting of a constant multiplied by the difference in depth between the search depth and the mid-depth of the depth band of interest, is added to the preliminary pilot ray angle to develop the final pilot ray angle. The search angle is selected as the angle that is closest to the pilot ray angle.

There are a number of deficiencies in the pilot ray algorithm. First, the algorithm only uses Snell's Law to determine the ray which vertexes at a greater depth, but since the rays are not traced there is no information as to the ranges that the rays achieve when vertexing. In addition, setting the angle to zero if the sound speed at the search depth is greater than the sound speed at the layer depth, essentially ignores the information available in the sound speed profile except for two depths, namely, the search depth and the layer depth. The algorithm also does not account for the weapon's attack angle, the torpedo's ceiling setting and the keel depth of a surface target.

SUMMARY OF THE INVENTION

It is therefore an object of the invention to provide a new and improved search angle selection system and method for surfaced targets.

The present invention provides a system and method that receives information regarding the current tactics, target, weapon and environment to generate an optimal search angle for each available search depth for the weapon. The invention generates estimates of the direction to point a narrow beam sonar in order to optimally insonify a shallow depth band near the surface of the ocean and to use the direction to determine the torpedo settings which come closest to matching the direction estimates. The depth band is associated with the keel depth of a surface ship. The direction to point the sonar is referred to as the "optimal off-axis angle," "critical angle," "critical ray," among others, and is an angle measured vertically up or down. The shallow depth band is associated with the keel depth of the surface craft.

The system provides an output which optimizes the torpedo's likelihood of acquiring a surface target. The system makes use of inputs including environmental, tactical, target and weapon parameters. The environmental parameters including such information as surface conditions, bottom conditions, and peculiarities in the water column therebetween. The surface conditions include such information as the sea state, wave height and wind speed. The bottom condition refers to the depth of the ocean. The water column is divided into a set of linear segments relating to sound speed gradients in the water.

The term "tactical information" refers to a class of items of information relating to the surface ship, including target Doppler, the target's keel depth (for a surface ship), the target's radiated noise and the acoustic target strength. Finally the term "surface tactic" refers to a surface ship target.

Weapon parameters include information as to the weapon's search depths, acoustic mode (active or passive), ceiling, floor, operational depth, search speeds and search angles.

The system receives the above-described parameter values and determines the optimal direction for placement of the acoustic beam pattern for maximal insonification of the depth band which brackets the target's operating depths. The optimal direction is the critical ray or angle. The weapon's search angle which is closest to this critical angle is the system's recommended search angle. The system determines the critical angle from ray theory at the weapon's sonar frequency. A number of sub-models are generated, including a ray trace model based on Snell's Law, an eigenray technique for determining which ray intersects a given range and depth, a model based on empirical data for determining the range/depth eigenpoint, and models of the weapon beam patterns and dynamic constraints. The system combines these sub-models and parameters elegantly to determine the optimal search angle without having to resort to enumeration or approximation techniques.

For a given environmental, tactical, target and weapon scenario, a region that is to be insonified is bounded in accordance with the invention. The search angle which best insonifies the region from the surface down to the target's keel depth out to the maximum acquisition range of the torpedo is determined; and this is also done for each search depth accounting for a weapon's attack angle, a weapon parameter. The search angle is determined as a set of attainable aimpoints along the surface which are based upon the environment and weapon parameters. The ray angles which intersect these aimpoints are then calculated and used to determine the optimal beam steering angle. It does this by iterating on search depth. Each search depth is characterized as a unique sound speed profile between the search depth and the surface. Utilizing this information, the maximum range that can physically be reached from this search depth is determined. Using this maximum range and the weapon's range gate (a weapon parameter), one aimpoint in range is established. Using information on the extend of the beam pattern used by the torpedo, another aimpoint, the minimum aimpoint, is determined. Based upon the requirements, a number of additional aimpoints are evenly spaced between the minimum and maximum aimpoints. The critical rays to all of these aimpoints are then found using iterative ray search techniques. From these critical angles, the optimal beam search angle is determined. The set of optimal search angles are passed, in a typical case, to a software module which accumulates tactical information and presets the operational parameters of the torpedo. A higher level software module ranks the search depth/search angle pairs and the best recommendation is sent as a control signal to the torpedo. This signal is received by the sonar controller function in the torpedo and instructs the torpedo's beamformer to so position the beam in the vertical plane.

BRIEF DESCRIPTION OF THE DRAWINGS

This invention is pointed out with particularity in the appended claims. The above and further advantages of this invention may be better understood by referring to the following description taken in conjunction with the accompanying drawings, in which:

DESCRIPTION OF THE PREFERRED EMBODIMENT

Figure 1:
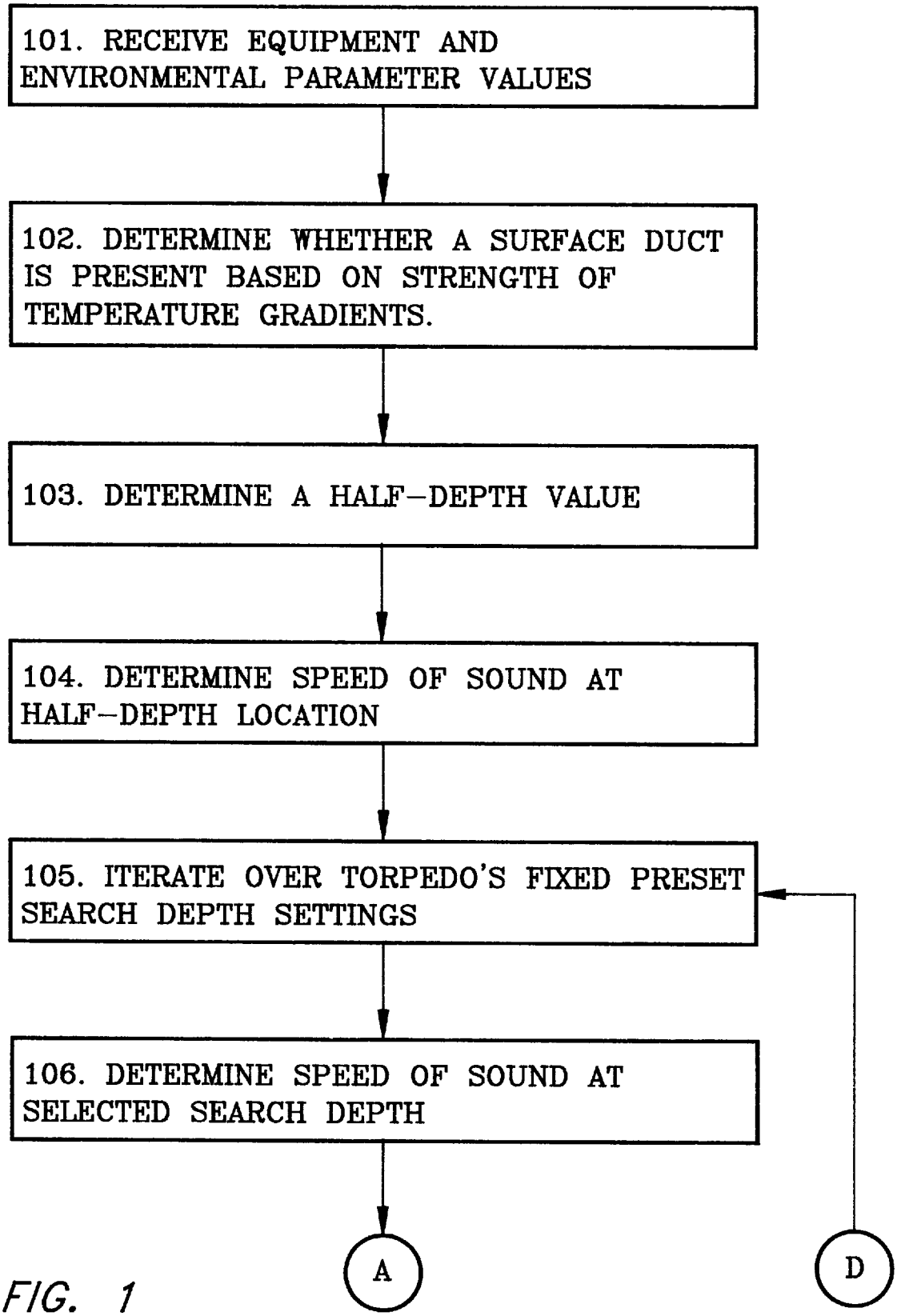
FIG. 1 is a flow diagram depicting operations performed by the search angle selection system in accordance with the invention.

FIG. 1 is a flow diagram depicting operations performed by the search angle selection system for an acoustic homing torpedo in accordance with the invention. It will be appreciated that the operations may be performed by any suitably programmed general purpose computer, which will not be described herein. Also, the torpedo may be selectively controlled to operate at a one of a plurality of fixed search depths, as by a presetting mechanism operatively associated with the launch equipment. The search angle selection system whose operations are outlined in FIG. 1 generates search angles for a surface tactic. Operations performed by a search angle selection system in connection with a number of other tactics, including (1) unknown submarine, (2) above layer and (3) below layer are described in the above-identified Cwalina application Ser. No. 08/885,702 (Naval Case No. 75003).

With reference to FIG. 1, initially the system receives equipment parameters and environmental inputs such as the sound speed profile as a function of ocean depth, the sea state, the bottom depth, the target type and a variety of target parameters (step 101) and proceeds to generate search angle selections for the surface tactic. In this operation, the system takes into account the possibility of peculiarities in the speed of sound near the surface which can strongly influence the ability of the weapon's sonar to distinguish a target floating on the surface. In that operation, the system considers the effect of sound refraction near the surface on the selection of a vertical search angle, which must optimally cover a shallow band adjacent the surface. Of interest in this case is the presence of a surface duct, that is, a strong negative temperature gradient extending downwardly from the surface, below which is a strong positive gradient which extends to a depth at which the speed of sound is greater than at the surface. The depth at which the speed of sound corresponds to the speed of sound at the surface is the conjugate depth. After receiving the parameters in step 101, the system determines if a surface duct is present, based on the strength of temperature gradients (step 102). A typical value to use in determining whether a surface duct is present is 0.05 (feet per second) per foot.

The presence of shallow near-surface gradients can effect sound propagation within a shallow depth band just below the surface of the ocean. Accordingly, since a surface ship's keel will extend below the ocean surface, and may extend below a sharp near-surface thermocline, the system does not use a zero depth for the surface tactic. However, the system does not use the keel depth itself, since a thermocline could end at the keel depth and therefore the keel would not provide enough signal strength for acquisition. Thus, the system compromises by using a half-depth figure which corresponds to one-half the depth of the keel of the ship on the ocean surface (step 103). The speed of sound at that depth is determined using conventional relationships relating the speed of sound to temperature, depth and sound wave frequency (step 104).

Because of temperature, pressure and salinity gradients in the ocean, sound can be refracted, channeled by boundary reflections, and ducted, all based upon the strength of the gradients, all of which can provide a bias in the selection of an optimum search angle. The system deals with the bias by modifying the critical angles in a manner which allows a beam steering angle to be found which allows the sonar to cover as much of the shallow surface band as possible without sacrificing coverage in range. The operations performed by the system in this connection will be described below beginning with step 105. In those operations, the system will iterate over the search depths, which are the torpedoes fixed preset search depth settings (step 105).

In each iteration (step 105), the system determines an optimum beam steering angle for one of the search depths. Initially, the system determines the speed of sound at the search depth (step 106) as a function of temperature, depth, salinity and frequency, or by a direct interpolation using a sound speed profile. Thereafter, the system generates a maximum aimpoint range value and a minimum aimpoint range value, a critical ray and an optimal direction for beam steering from the critical ray. From these values, the search angles can be generated.

In generating the maximum aimpoint range value and the critical ray to the maximum aimpoint range, the system uses a ray-tracing technique making use of Snell's Law of refraction. The tracing takes place on a Cartesian grid where the vertical axis is depth and the horizontal axis is range. Rays are traced in arcs whose radii are functions of torpedo launch angle, sound speed and the particular gradient in a segment of the sound speed profile. The system traces the rays from a source depth, namely, a point at the search depth at zero range, to an aimpoint, namely, a point at the half depth with a selected known range.

Accordingly, in generating the maximum aimpoint range value and the critical ray thereto, the system initially categorizes the sound speed profile between the search depth and the half depth (step 107). This characterizes the gradients between the search depth and the half depth, which is used in determining the initial rays to trace. Thereafter, the system sets the maximum aimpoint to a desired value, in particular, the weapon's range gate, which corresponds to the maximum range for which the torpedo is designed to acquire a target (step 108). The system then uses the sound speed profile and ray tracing to determine the maximum range that can be intersected at the half depth and the launch angle that reaches the range (step 109) and determines whether the range (the maximum aimpoint range) is greater than the range gate (step 110). In response to a positive determination in step 110, the system sets the maximum aimpoint range to correspond to the range gate (step 111). On the other hand, if the system makes a negative determination in step 110, the range gate is greater than the maximum aimpoint range, and so the system generates the critical ray that intersects it (step 112).

Thereafter, the system determines the minimum aimpoint range value. In that operation, the system uses the critical ray generated in step 112, along with beam pattern parameters to determine the minimum aimpoint range. Typically, narrow beam high frequency sonar systems have a lobed beam pattern which is approximately symmetric about their main response axes. The main lobe extends typically ten to twenty degrees off the main response axis. For optimal insonification of the surface, the critical ray that intersects the maximum aimpoint range must be placed on the beam pattern such that most of the energy in the beam is contained in angles greater than the critical ray. This defines an angle on the other side of the beam pattern, that is, two off-axis values exist for each due to the approximate symmetry of the beam pattern around the main response axis. Placing the beam pattern point on the critical ray defines another angle which intersects the beam pattern on the other side of the main response axis, which angle is used to determine the minimum aimpoint range.

The system generates a critical angle used to determine the minimum aimpoint range by adding half the total main lobe range for the beam to the critical ray that intersects the maximum aimpoint range (step 113). The system then traces the ray to the surface using conventional ray tracing techniques (step 114) and selects a minimum aimpoint range as the range for the ray (step 115). The system uses two angles, namely the critical angles for the rays that intersect the minimum and maximum aimpoint ranges, as the angular spacing which effectively covers the surface from the current search depth. However, because the curve for range as a function of angel is not linear, it is not suitable to assume that the average of the two is the beam steering angle. Instead, the system defines a span of uniformly spaced range aimpoints between the minimum and maximum aimpoint ranges and uses the angles that intersect these intermediate aimpoints to determine the optimum beam steering angle (step 116). The system may perform these operations for a number of minimum and maximum aimpoints, and average the values so generated.

Following step 116, the system has generated a set of critical rays which intersect the point which provides optimal coverage for a surface target with a given keel depth. Since the torpedo can only accept specific predetermined search angle values, the system then determines for each depth an appropriate search value. In that operation, the system again iterates over the search depths (step 117). For each search depth, the system generates a buoyancy correction parameter that corrects for the angular deviations caused by the buoyancy of the particular weapon (step 118) and corrects the previously-generated beam steering angles in accordance therewith (step 119). The results constitute the optimal beam-steering angles for each search depth. Since the torpedo can only accept certain predefined fixed values, the system determines the predefined fixed values nearest the respective angles determined in step 119 as the selected search angles (step 120).

The system provides a number of advantages. For example, it accepts and processes measured environmental data without modification, allowing direct generation of search angles over a large number of environments. In addition, it accounts for a far larger number of environmental variables than, for example, the pilot ray algorithm described above.

The preceding description has been limited to a specific embodiment of this invention. It will be apparent, however, that variations and modifications may be made to the invention, with the attainment of some or all of the advantages of the invention. Therefore, it is the object of the appended claims to cover all such variations and modifications as come within the true spirit and scope of the invention.

What is claimed is:

1. A search angle selection system for determining acoustic homing beam offset angles for respective ones of a plurality of fixed search depths at which a torpedo may be selectively controlled to operate, to be used against a surface target depth condition, said system comprising:

environmental parameter determining means for determining values for predetermined environmental parameters;

critical ray generation means for generating, for each of a plurality of search depths, a maximum and minimum aimpoint values and corresponding critical rays;

beamsteering angle generation means for processing the critical rays generated by said critical ray generation means to generating beamsteering angles; and search angle selection means for selecting, for each beamsteering angle generated by said beamsteering angle generation means, one of the torpedo's preselected search angles as the search angle for the associated search depth.

2. A system as defined in claim 1 in which the search angle selection means selects as the search angle for each search depth the torpedo's preselected search angle that is closest to the beam steering angle.

3. A system as defined in claim 1 in which the critical ray generation means includes:

sound speed profile generating means for generating a sound speed profile from the ocean surface;

maximum aimpoint range generation means for generating a maximum aimpoint range in response to the torpedo's maximum range and the associated ray angle to the surface;

minimum aimpoint range generation means for generating a minimum aimpoint range in response to the ray angle for the minimum aimpoint range;

aimpoint span generating means for generating a span of uniformly-spaced aimpoints from the minimum and maximum aimpoint ranges; and beam steering angle generating means for generating an optimal beam steering angle from the span of uniformly-spaced aimpoints.

4. A search angle selection method for determining acoustic homing beam offset angles for respective ones of a plurality of fixed search depths at which a torpedo may be selectively controlled to operate, to be used against a surface target depth condition, said method comprising the steps of:

determining values for predetermined environmental parameters;

generating, for each of the plurality of search depths, a maximum and minimum aimpoint values and corresponding critical rays;

processing the critical rays to generate beamsteering angles; and selecting, for each beamsteering angle, one of the torpedo's preselected search angles as the search angle for the associated search depth.

5. A method as defined in claim 4 in which the search angle for each search depth is selected from the torpedo's preselected search angle that is closest to the beam steering angle.

6. A method as defined in claim 4 in which the critical rays are generated according to the steps of:

generating a sound speed profile from the ocean surface;

generating a maximum aimpoint range in response to the torpedo's maximum range and the associated ray angle to the surface;

generating a minimum aimpoint range in response to the ray angle for the minimum aimpoint range;

generating a span of uniformly-spaced aimpoints from the minimum and maximum aimpoint ranges; and generating an optimal beam steering angle from the span of uniformly-spaced aimpoints.

* * * * *

UNITED STATES PATENT AND TRADEMARK OFFICE

CERTIFICATE OF CORRECTION

PATENT NO. : 5,824,946

DATED : October 20, 1998

INVENTOR(S) : David S. Cwalina

It is certified that error appears in the above-identified patent and that said Letters Patent is hereby corrected as shown below:

Column 4, line 21, delete "FIG. 1 is" and insert --FIGS. 1, 1A, 1B, and 1C compositely constitute--.

Figure 1A:
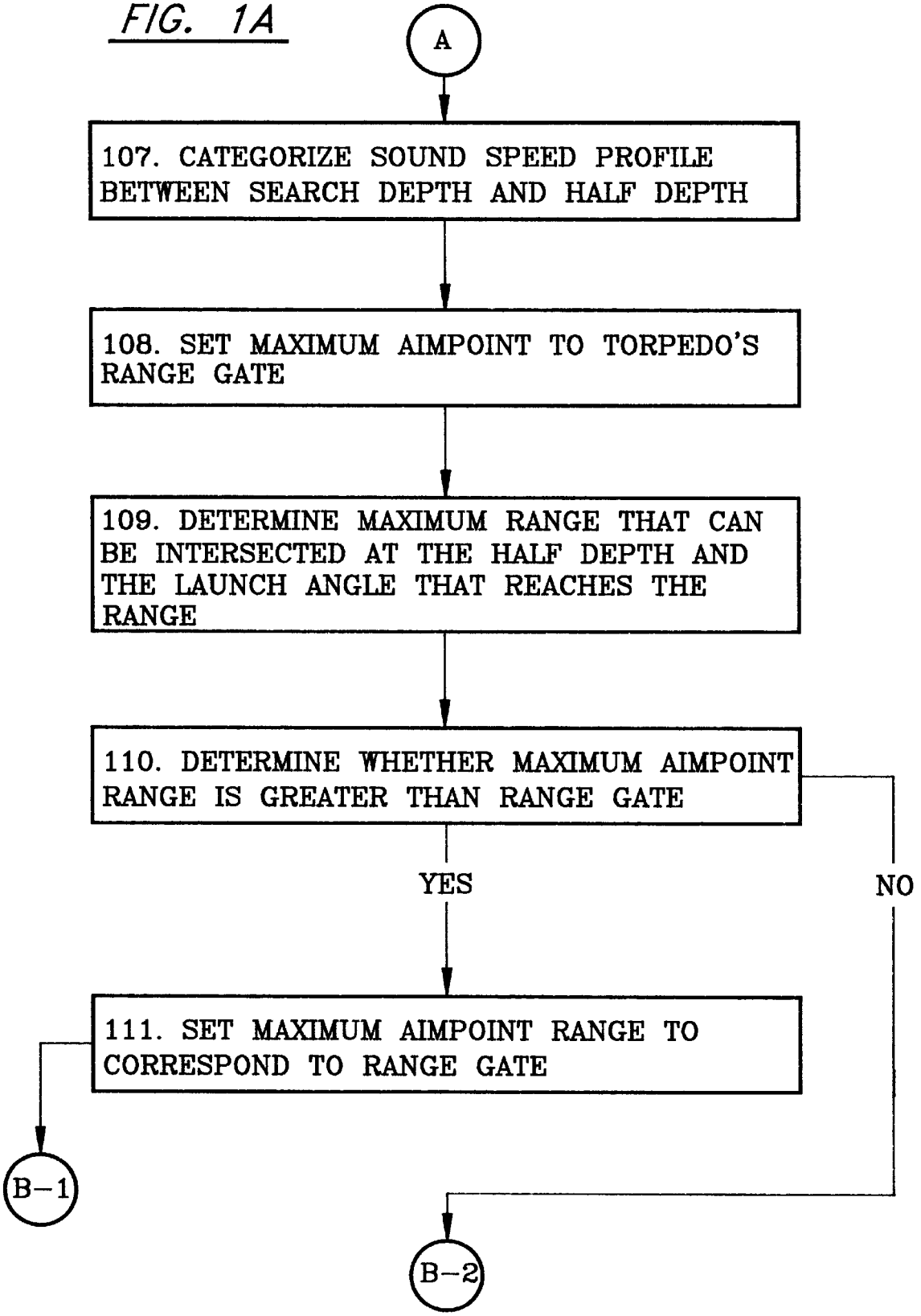
Figure 1B:
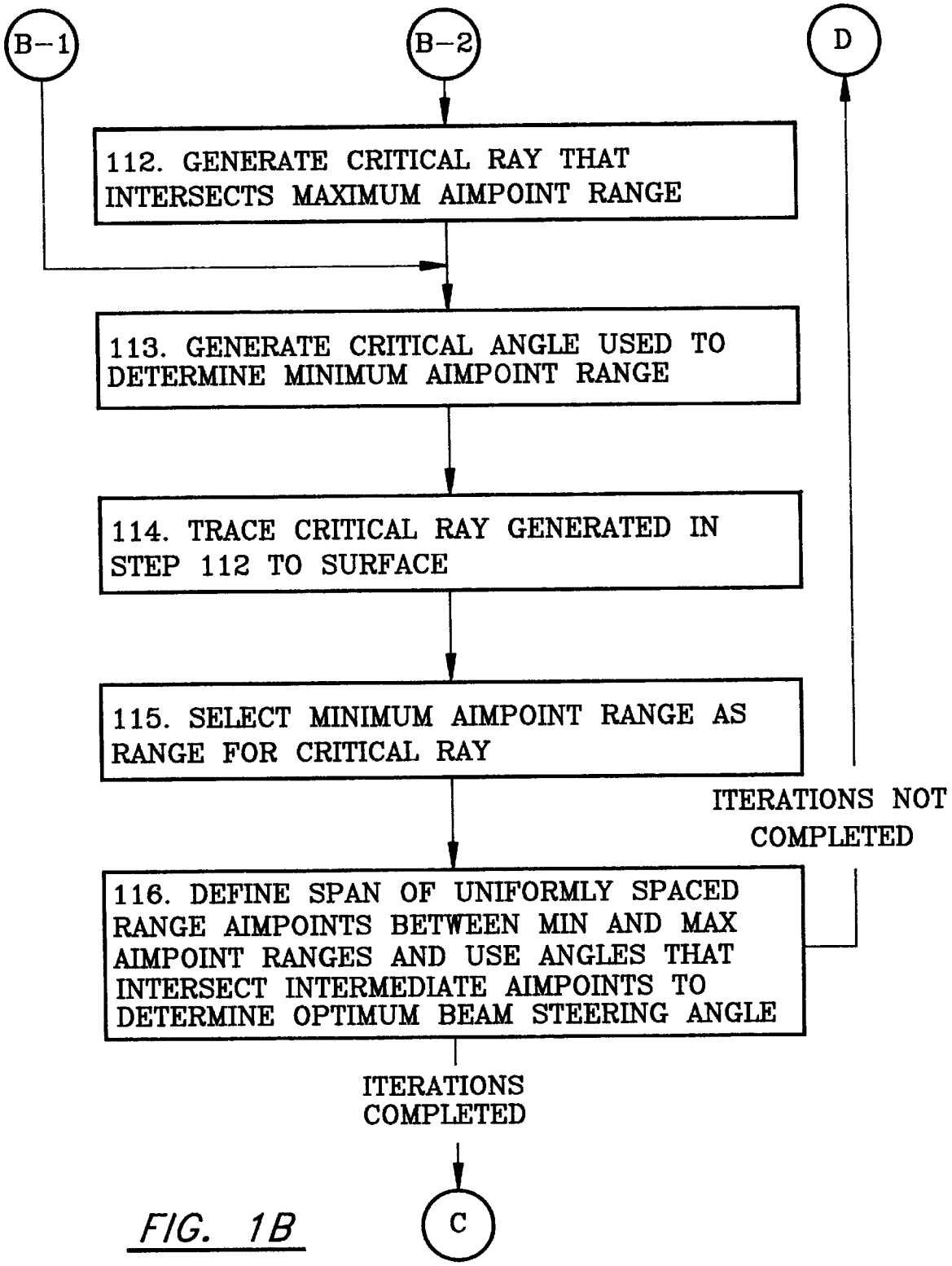
Figure 1C:
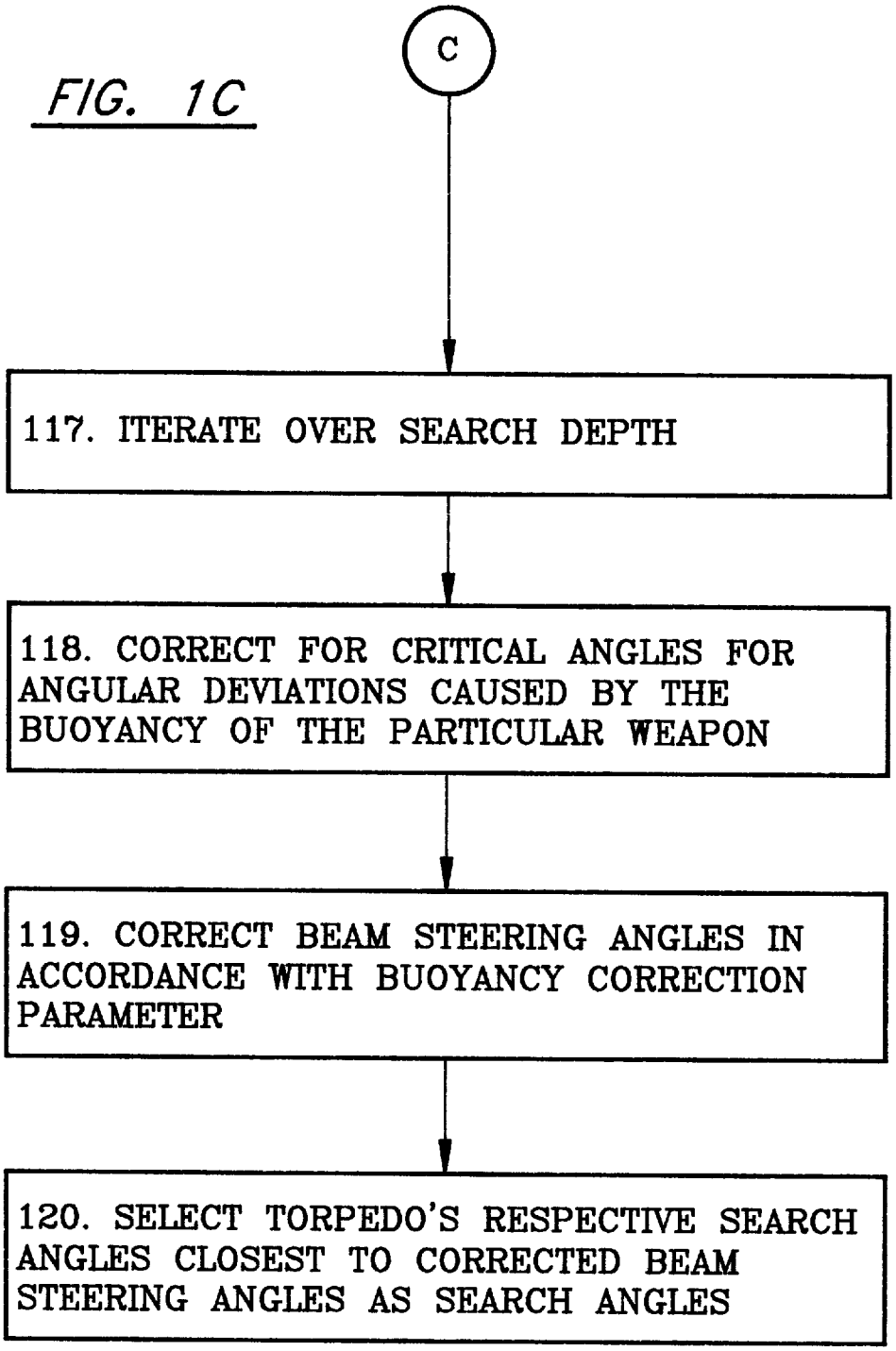

Column 4, line 28, delete "FIG. 1 is" and insert --FIGS. 1 through 1C are--.

Column 5, line 50, delete "Accordingly" and insert --Referring now to FIG. 1A, accordingly--.

Column 5, line 64, delete "In" and insert --Referring now to FIG. 1A in conjunction with FIG. 1B, in--.

Column 6, line 22, delete "The" and insert --Referring now to FIG. 1B, the--.

UNITED STATES PATENT AND TRADEMARK OFFICE

CERTIFICATE OF CORRECTION

PATENT NO. : 5,824,946

DATED : October 20, 1998

INVENTOR(S) : David S. Cwalina

It is certified that error appears in the above-identified patent and that said Letters Patent is hereby corrected as shown below:

Column 6, line 47, delete "In" and insert -- Referring now to FIG. 1C, in--.

Signed and Sealed this

Twenty-third Day of February, 1999

*Attest:*

Q. TODD DICKINSON

*Attesting Officer*

*Acting Commissioner of Patents and Trademarks*